US005332154A

United States Patent [19]

Maier et al.

[11] Patent Number: 5,332,154

[45] Date of Patent: Jul. 26, 1994

[54] SHOOT-UP ELECTROSTATIC NOZZLE AND METHOD

[75] Inventors: Barry G. Maier; Bruce A. Hunnicutt, both of Anderson, Ind.

[73] Assignee: Lundy and Associates, Ft. Wayne, Ind.

[21] Appl. No.: 843,007

[22] Filed: Feb. 28, 1992

[51] Int. Cl.[5] ..... B05B 5/035

[52] U.S. Cl. ..... 239/3; 239/690; 239/696; 239/708

[58] Field of Search ..... 239/3, 690, 690.1, 696, 239/708

[56] References Cited

U.S. PATENT DOCUMENTS

| | | | |
|---|---|---|---|
| 705,691 | 7/1902 | Morton | 239/3 |
| 2,302,289 | 11/1942 | Bramston-Cook . | |
| 2,723,646 | 11/1955 | Ransburg | 239/690 X |
| 2,777,784 | 1/1957 | Miller . | |
| 3,060,429 | 10/1962 | Winston . | |
| 3,248,253 | 4/1966 | Barford et al. . | |
| 3,577,198 | 5/1971 | Beam . | |
| 3,579,245 | 5/1971 | Berry . | |
| 3,656,171 | 4/1972 | Robertson . | |
| 3,698,635 | 10/1972 | Sickles . | |
| 3,802,625 | 4/1974 | Buser et al. . | |
| 4,004,733 | 1/1977 | Law . | |
| 4,009,829 | 3/1977 | Sickles . | |
| 4,106,697 | 8/1978 | Sickles et al. . | |
| 4,188,413 | 2/1980 | Lupinski et al. . | |
| 4,215,818 | 8/1980 | Hopkinson . | |
| 4,221,185 | 9/1980 | Scholes et al. . | |
| 4,266,721 | 5/1981 | Sickles . | |
| 4,324,117 | 4/1982 | Schwob et al. . | |
| 4,341,347 | 7/1982 | DeVittorio . | |
| 4,431,137 | 2/1984 | Prewett et al. | 239/690 |
| 4,476,515 | 10/1984 | Coffee . | |
| 4,749,125 | 6/1988 | Escallon . | |
| 4,788,016 | 11/1988 | Colclough et al. | 239/3 X |
| 4,830,872 | 5/1989 | Grenfell | 239/3 X |
| 4,845,512 | 7/1989 | Arway . | |
| 5,086,972 | 2/1992 | Chang et al. | 239/708 X |
| 5,086,973 | 2/1992 | Escallon et al. | 239/3 |

FOREIGN PATENT DOCUMENTS

| | | |
|---|---|---|
| 194074 | 10/1986 | European Pat. Off. . |
| 216502 | 1/1987 | European Pat. Off. . |
| 754478 | 11/1953 | United Kingdom . |

*Primary Examiner*—Andres Kashnikow
*Assistant Examiner*—William Grant
*Attorney, Agent, or Firm*—Lundy & Associates

[57] ABSTRACT

An electrostatic spray nozzle that is positioned at an angle above horizontal and less than vertical having a body with an upper fluid emitting end and a lower bottom end. The body having an interior cavity therein. Within the cavity is a shim capable of conducting electricity that defines an opening at the fluid emitting end and a channel that joins the fluid emitting end opening to a supply of flowable material. The body has an enclosed electrode external adjacent to and below the emitting end. Both the shim and the electrode are electrically connected to a voltage source. The nozzle, in operation, bends the field adjacent the emitting end upwardly in accordance with the method of the invention.

58 Claims, 4 Drawing Sheets

SHOOT-UP ELECTROSTATIC NOZZLE AND METHOD

BACKGROUND OF THE INVENTION

The present invention pertains to electrostatic spray nozzles, and more particularly to a nozzle for emitting liquids and other flowable materials upwardly onto a target in a highly controllable and efficient fashion at a highly increased rate of material flow through the nozzle.

The application of fluids and other flowable materials onto a substrate using electrostatically operated nozzles has been heretofore proposed. One nozzle apparatus of the proposed type is found in Escallon's U.S. Pat. No. 4,749,125; the nozzle has a housing with mutually tapering sides that form a pointed dispensing end. There is a fluid duct joining a fluid reservoir to the nozzle housing interior. Fluid is introduced to the nozzle by a fluid delivery system at sufficient pressure to deliver fluid to the dispensing end of the electrostatic nozzle. As the fluid travels within the nozzle housing, it is electrostatically charged and upon reaching the emitting end forms a meniscus and subsequently erupts into a plurality of flow paths. Today there is an increasing demand for a nozzle of this character that can accomplish larger flow rates utilizing a broader spectrum of different flowable materials than ever before. Additionally, industry demands a new nozzle configuration capable of effectively emitting flowable materials upwardly for coating or covering the underside of a target.

Nozzles typical of Escallon, however, are limited in their ability to effectively spray upwardly an amount of flowable material that will meet all of these demands. One problem is "flooding". Because of the nozzle's orientation in an upwardly spraying position and a lack of hydraulic or pneumatic forces on the fluid or flowable material, the gravitational forces must be overcome in order to emit the flowable material upwardly. Depending on the viscosity and/or surface tension of the flowable material, flooding of the nozzle tip is a frequent and formidable occurrence which may be caused by a momentary loss of high voltage. At the onset of flooding, physical forces of the flowable material such as surface tension and adhesion to nozzle surfaces create a path leading the fluid down and away from the emitting edge. This fluid path cannot always be overcome with electrostatic forces. Although an upward spray still occurs, an uncontrollable percentage of flowable material begins to stream over the emitting edges of the nozzle. Eventually, the flowable material begins to misfire from the nozzle tip at locations that preclude controlled coating of the overhead target and in some instances misses the target altogether.

The overflowing or flooding of the nozzle can be corrected by shutting down the nozzle, wiping the outer portion of the nozzle emitting edge, and restarting the spray. However, since many of these lines of production are intended to be continuous operations, shut down and wiping of the nozzle is neither an economical nor an acceptable procedure.

Another complication is the "purge cycle" that is incorporated in some industrial operations. Purge, in essence, flushes the thru-put material out of the system and replaces it with another material at high volume flow rates. This flushing cycle causes a forced hydraulic flooding of the nozzle. Depending on the variety of work being processed on the line, purging may occur several times each day. The purge cycle thoroughly drenches the emitting edge of the nozzle as the materials are flushed through the nozzle. Consequently, flooding and misfiring often result when attempting to restart the system.

An alternative nozzle for dispensing flowable materials upwardly, described in U.S. Pat. No. 4,830,872 utilizes a nozzle blade having two side pieces with a space therebetween in a vertical orientation. The flowable material exits the space and is charged with a working potential of 50 to 120 kv. An electrostatic field is established between the blade end and the object to be coated. The charge has to be applied in a reliable manner taking into consideration aspects of personal safety. Hazards include sparking or arcs in the presence of potentionally flamatory solvent-borne materials, such as paint, as well as the potential for operator shock. Energy efficiency is also an important factor.

It is therefore highly desirable to provide an improved electrostatic spray nozzle.

It is also highly desirable to provide an improved electrostatic spray nozzle and method that is capable of spraying upwardly.

It is also highly desirable to provide an improved electrostatic spray nozzle and method that is capable of spraying upwardly at relativity higher flow rates.

It is also highly desirable to provide an improved electrostatic spray nozzle and method that is self-correcting and will overcome the affects of "flooding" without operator assistance.

It is also highly desirable to provide an improved electrostatic spray nozzle and method capable of avoiding the flooding problems characteristic of a more or less vertical nozzle orientation where gravitational forces affect spraying ability.

It is also highly desirable to provide an improved electrostatic spray nozzle and method capable of overcoming the adhesive forces of flowable materials and nozzle surfaces.

It is also highly desirable to provide an improved electrostatic spray nozzle and method capable of overcoming the surface tension forces of flowable materials.

It is also highly desirable to provide an improved electrostatic spray nozzle and method that are immune to the characteristics attributable to a purge cycle.

It is also highly desirable to provide an improved electrostatic spray nozzle and method that need not be shut down in an operation requiring continuous production.

It is also highly desirable to provide an improved electrostatic spray nozzle and method that operates at economically efficient and operator-safe voltage and current levels.

It is finally highly desirable to provide an improved electrostatic spray nozzle and method having all of the above-mentioned characteristics.

SUMMARY OF THE INVENTION

It is therefore an object of the invention to provide an improved electrostatic spray nozzle.

It is also an object of the invention to provide an improved electrostatic spray nozzle and method that is capable of spraying upwardly.

It is also an object of the invention to provide an improved electrostatic spray nozzle and method that is capable of spraying upwardly at relatively higher flow rates.

It is also an object of the invention to provide an improved electrostatic spray nozzle and method that is self-correcting and will overcome the affects of "flooding" without operator assistance.

It is also an object of the invention to provide an improved electrostatic spray nozzle and method capable of avoiding the flooding problems characteristic of a more or less vertical nozzle orientation where gravitational forces affect spraying ability.

It is also an object of the invention to provide an improved electrostatic spray nozzle and method capable of overcoming the adhesive forces of flowable materials and nozzle surfaces.

It is also an object of the invention to provide an improved electrostatic spray nozzle and method capable of overcoming the surface tension forces of flowable materials.

It is also an object of the invention to provide an improved electrostatic spray nozzle and method that are immune to the characteristics attributable to a purge cycle.

It is also an object of the invention to provide an improved electrostatic spray nozzle and method that need not be shut down in an operation requiring continuous production.

It is also an object of the invention to provide an improved electrostatic spray nozzle and method that operates at economically efficient and operator-safe voltage and current levels.

It is finally an object of the invention to provide an improved electrostatic spray nozzle and method having all of the above-mentioned characteristics.

In the broader aspects of the invention there is provided an electrostatic spray nozzle that is positioned at an angle above horizontal and less than vertical having a body with an upper fluid emitting end and a lower bottom end. The body having an interior cavity therein. Within the cavity is a shim capable of conducting electricity that defines an opening at the fluid emitting end and a channel that joins the fluid emitting end opening to a supply of flowable material. The body has an enclosed electrode external adjacent to and below the emitting end. Both the shim and the electrode are electrically connected to a voltage source. The nozzle, in operation, bends the field adjacent the emitting end upwardly in accordance with the method of the invention.

BRIEF DESCRIPTION OF THE DRAWINGS

The above mentioned and other features and objects of the invention and the manner of attaining them will become more apparent and the invention itself will be better understood by reference to the following description of an embodiment of the invention taken in conjunction with the accompanying drawings, wherein.

DESCRIPTION OF A SPECIFIC EMBODIMENT

Figures 1, 2, 3:
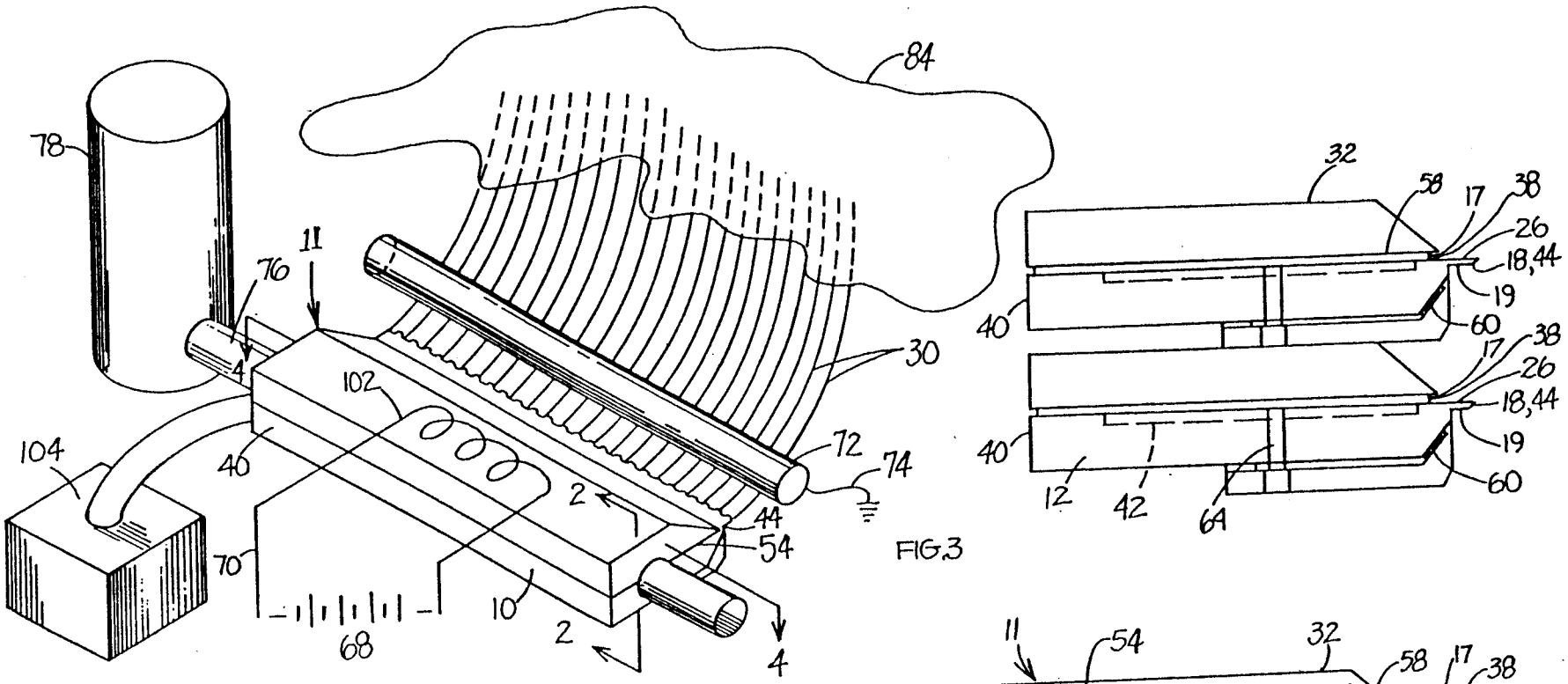
FIG. 1 is a perspective view of the nozzle apparatus of the invention illustrating the spray nozzle, the fluid delivery system, the voltage source, a target, an inductor bar, and a plurality of fluid flow paths.
FIG. 2 is a cross-sectional view of the nozzle taken substantially along section line 2—2 of FIG. 1.
FIG. 3 illustrates two nozzles such as shown in FIG. 2 stacked in accordance with the invention.

Referring now to FIG. 1, the spray nozzle 11 is illustrated comprising fluid delivery system 78, nozzle body 10, high voltage power supply 68, and flow paths 30. In the specific embodiment illustrated, target 84 is positioned above and over the emitting end 44 of nozzle body 10 in proximity of the trajectory of fluid flow paths 30. Target 84 is electrically biased with respect to nozzle 11 and in the embodiment of the invention illustrated is shown grounded by ground line 74.

Fluid delivery system 78 provides fluid to nozzle body 10.

Nozzle body 10 comprises first and leading side member 12 and second and following side member 32 as shown in FIG. 2. Side members 12 and 32 define a hollow interior chamber 42. Referring to FIG. 1, chamber 42 is filled with fluid from fluid delivery system 78. Fluid is introduced into the hollow chamber 42 via fluid duct 76. Nozzle body 10 is made of electrically insulative material, such as plastic. Spray nozzle 11 is mounted with emitting end 44 directed upwardly relative to bottom 40 and, in specific embodiments, defines an orientation which is always more than horizontal and always less than vertical. Target 84 is positioned above and over emitting end 44.

Side member 12 and side member 32 also define slot 54 at emitting end 44. The embodiment illustrated in FIG. 11 has nozzle tip 18 of side member 12 with serrations 20 extending beyond second side member 32 at emitting end 44.

Fluid delivery system 78 maintains flowable material 82 in the spray nozzle 11 at a selected pressure within interior chamber 42. Resistive coils 102 or other heating means may be embedded in the nozzle body 10 and connected at 70 to power source 104. The pressure of fluid delivery system 78 is never sufficient to force the fluid to spray out of emitting end 44, but only to flow into interior chamber 42 and to fill the same and to flow to emitting end 44 where it is electrostatically emitted as flow paths 30. In any specific embodiment, the pressure used is very small and is typically less than 15 psig at emitting end 44.

Figure 4:
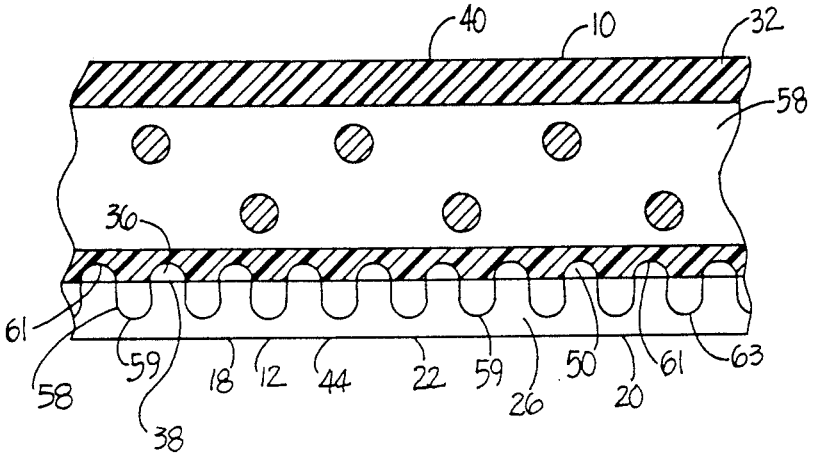
FIG. 4 is a fragmentary cross-sectional view of the body and interior chamber of the spray nozzle showing one embodiment of the shim taken substantially along section line 4—4 of FIG. 1.

Referring now to FIGS. 2 and 4, a shim 58 is positioned within slot 54 thereby defining with precision a plurality of channels 50 and one transverse dimension of channels 50. See FIG. 4, Shim 58 also defines with precision the other transverse dimension of channels 50 and the width 52 of slot 54. See FIG. 4. The selection of a particular shim 58 and positioning of shim 58 in slot 54 determines the dimensions of channels 50. The dimensions of channels 50 ultimately control the flow of fluid and its lateral distribution at a given pressure through the nozzle.

Shim 58 partially occludes slot 54. Shim 58 can be made of conductive material, such as metal, or made of nonconductive material, for example, plastic. FIG. 4 shows shim 58 to have a discontinuous edge 63 including crests 59 and valleys 61. The discontinuous edge 63 defines a plurality of channels 50 as described above at valleys 61 and allows flowable material to flow from interior cavity 42 through slot 54. In a specific embodiment, shim edge 63 is scalloped as shown in FIG. 4 or otherwise shaped. Each of these shim shapes includes smoothly rounded distal ends so as not to concentrate the charge at shim edge 63.

The fluid in cavity 42 is in contact with shim 58 and flows through channels 50 between side members 12 and 32. At a selected field strength and a selected shim position of a selected shim, the flow of fluid to the first and second nozzle lips 26, 38, respectively, is a linear function of the pressure within the interior chamber 42. A different straight line function of fluid flow/pressure can be obtained by increasing the field strength, by increasing the thickness of the shim, or by positioning the shim differently so as to select different sized channels 50. At either end of the operable pressure range, at pressures lower than sufficient to cause sprayable fluid flow to the emitting end 44 or at pressures large enough to cause nozzle 11 to flood, this straight line relationship between fluid flow and pressure does not exist. In a specific embodiment, however, the nozzle 11 is operated in a controllable fashion and this relationship does exist over a fluid flow range of 20 times the minimum operable fluid flow. By altering the geometrical dimensions of the nozzle tip 18 with edge 17, i.e., by using any one of a variety of shim shapes, the nozzle of the invention can be used to emit a great variety of fluids upwardly onto an underneath of a target 84 in a controllable fashion.

Nozzle body 10 and side members 12 and 32 are constructed of flexible, resilient, electrically insulative materials such as acrylic plastic. The assembly of the nozzle for a given purpose involves a selection of a properly dimensioned shim 58 and the insertion of the shim into the nozzle in the position shown in the figures. The shim extends longitudinally along nozzle 10 within the slot 54. As shown, shim 58 is recessed from the tip of emitting end 44, thus eliminating ionization of the air surrounding the nozzle and the possibility of unintentional operator contact with it from the exterior during operation enhancing the safety of the nozzle. In a specific embodiment, shim 58 is recessed from emitting end 44 about 0.05 inches. By the proper selection of shim 58, the flow characteristics are determined as the fluid in cavity 42 flows through the opening of channels 50 between the side members 12 and 32 in response to the fluid delivery system 78.

Shim 58 is electrically connected to high voltage power supply 68. High voltage from power supply 68 is electrically connected to shim 58 in any conventional manner such as a conductive screw or bolt or electrical connector.

Figure 5:
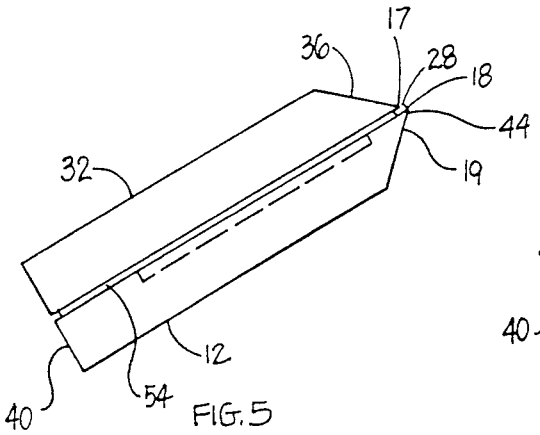
FIG. 5 is a fragmentary cross-sectional view of a nozzle similar to that shown in FIG. 2 illustrating a generally symmetrical nozzle geometry and a convex meniscus formation without an inductor bar and without the force fields associated therewith.
Figure 6:
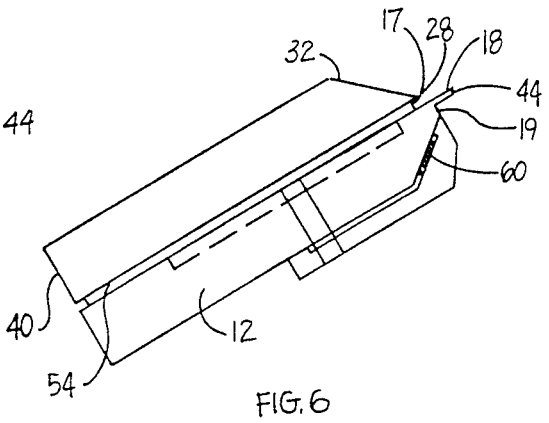
FIG. 6 is a fragmentary cross-sectional view of a nozzle similar to that shown in FIG. 2 showing a generally asymmetrical nozzle geometry with a concave meniscus formation without an inductor bar and without the force fields associated therewith.

The flow of liquid into the slot 54 and past shim 58 positions fluid between the side members 12 and 32 at the nozzle tip 44. This fluid may produce an outwardly protruding meniscus having a generally convex exterior surface. By properly selecting the dimensions of side members 12 and 32 with the fluid to be dispensed, the operation of the nozzle can be controlled. Choosing a symmetrical nozzle as shown in FIG. 5 and a fluid which forms an outwardly curved meniscus, results in a controlled operation of the nozzle of the invention, and fluids can be dispensed from the nozzle as herein described. However, by selecting a fluid which forms a meniscus having a different shape, erratic or noncontrollable flow may result from the same nozzle. Where the emitting end 44 geometry is chosen to be asymmetrical with side members 12 and 32 of different lengths as illustrated in FIGS. 6, 11 through 13, a fluid must be chosen which forms a concave meniscus in order for fluid to be dispensed from the nozzle of the invention in a controllable manner as above described. If a fluid which forms an outwardly curved generally convex meniscus is used with the asymmetrical nozzle configuration, erratic and noncontrollable fluid flow may be experienced. Thus, by altering the geometrical dimensions of the nozzle side members 12 and 32 and choosing appropriate fluids, the geometry of the meniscus 28 can be altered and the nozzle of the invention can be used to dispense a great variety of fluids in a controllable fashion.

In a specific embodiment shown in FIG. 2, nozzle body 10 can be heated by resistive coils 102 through an isolation transformer. Whether or not nozzle body 10 is heated in a specific application depends upon the material being dispensed.

Referring now to FIGS. 1 through 13, target 84 is positioned above nozzle body 10. In a specific embodiment, target 84 may be empty space or metallic, wood, paper, glass, plastics, organic material such as plants and food stuffs, in any one of a multitude of forms, such as webs, sheets, filaments, loose objects, etc. In specific embodiments, the target may be as far as fourteen inches away from the nozzle of the invention. Fluid delivery system 78 causes fluid to travel from fluid delivery system 78 via fluid duct 76 into interior cavity 42 of nozzle body 10. Voltage source 68 is connected to shim 58. Shim 58 and electrode 60 are maintained at a voltage of about 10 to about 50 kV at about 60 to about 300 micro amps, depending on the resistivity of fluid to be emitted from nozzle body 10. In the embodiment illustrated, the distance between the channel lips 26, 38 and the tip 18 depends on the viscosity and resistivity of the flowable material, but ranges from about 0.019 inches to about 0.250 inches. Fluid viscosities range from under 1 to about 20,000 centipoise. Fluid resistivities range from about $5\times10^6$ to about $2.2\times10^{11}$ ohm cm.

Figure 12:
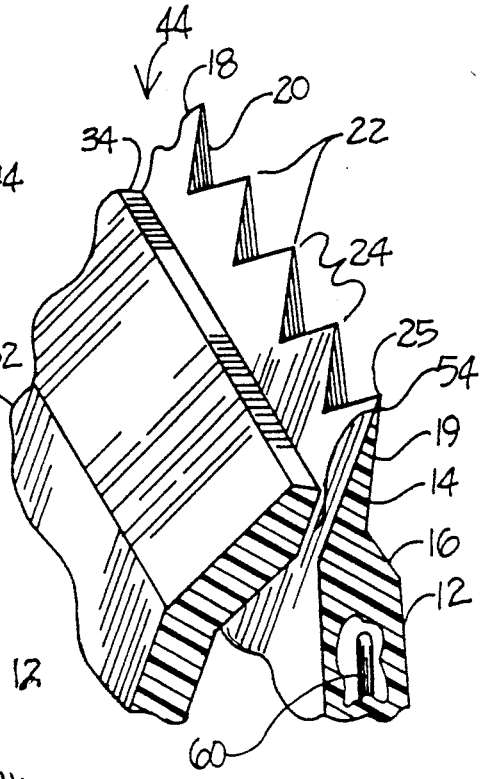
FIG. 12 is a fragmentary perspective view of the spray nozzle of the invention having an asymmetrical geometry, no shim, positioned less than vertically, and showing the enclosed electrode and insulative cap of the invention.

Fluid is made to fill the hollow interior cavity 42 and proceed via channels 50 to emitting end 44. While contacting electrified shim 58, the fluid becomes electrically charged. A meniscus 28 forms at tip 18 and errupts into flow paths 30 of charged droplets 100 as shown in FIG. 12. As the fluid flows to edges 20, 22 the fluid becomes repulsed by enclosed electrode 60 of like charge. The location of flow paths 30 emanating from the nozzle body 10 is dependent upon the concentration of charge at the tip 18 of nozzle 10. In the smooth, continuous lip versions of the nozzle illustrated in FIG. 4, flow paths 30 may occur anywhere along the tip 18 of the nozzle of the invention, and the location of the ligaments along the tip 18 of the nozzle of the invention is erratic. They may occur at different positions at different times and the positions of the flow paths 30 are not precisely controlled or fixed in position.

Figure 11:
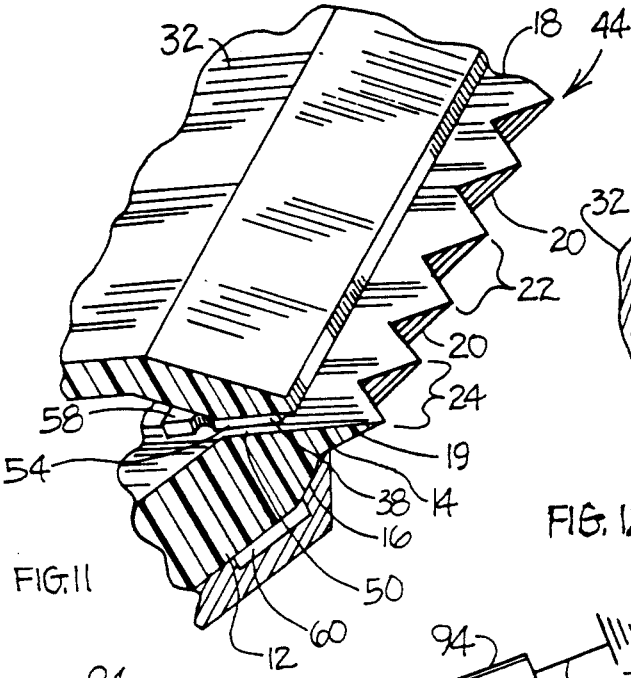
FIG. 11 is a fragmentary perspective view of the spray nozzle of the invention having an asymmetrical nozzle geometry, positioned more than horizontally and showing an enclosed external electrode and a serrated tip.
Figure 13:
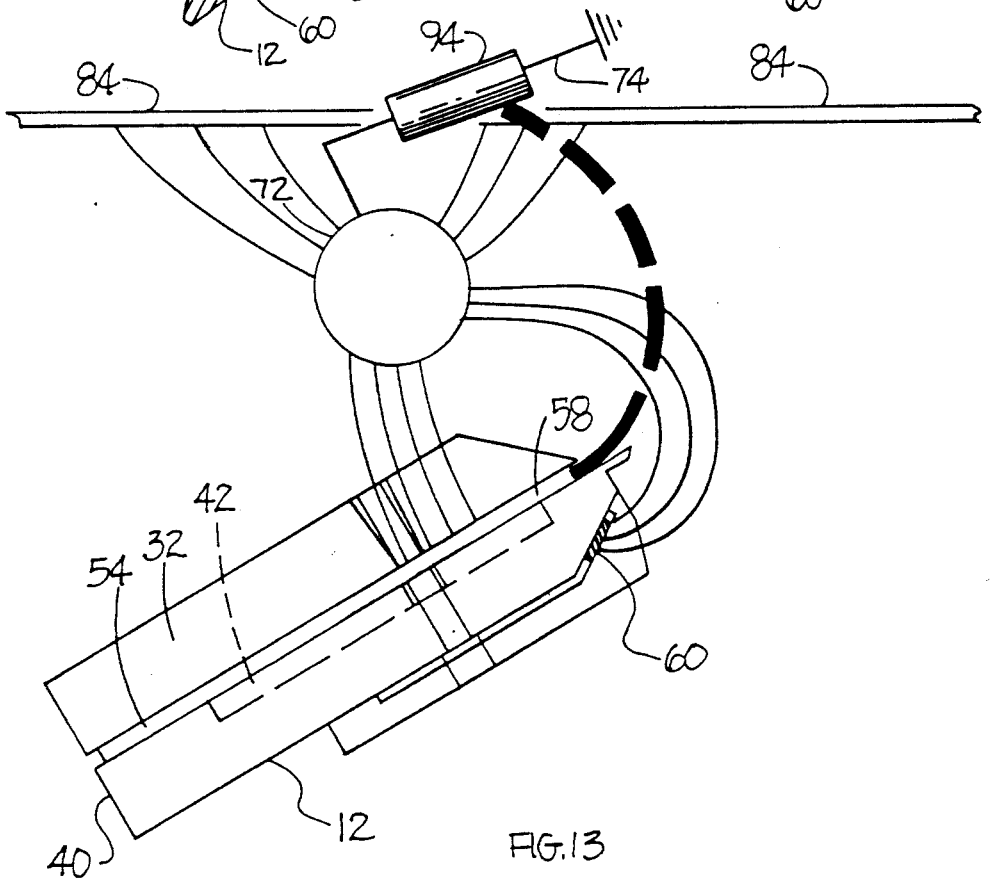
FIG. 13 is another fragmentary perspective view of the spray nozzle of the invention similar to that shown in FIG. 1 with additional apparatus for producing droplets and diverting the flow path upwardly.

In an asymmetrical nozzle configuration like that shown in FIGS. 11 through 13 where lip 38 is serrated to form a plurality of charge concentrating peaks 22 spaced along the length of the nozzle 10, the serrated nozzle tip 18 positions the flow paths 30 at the peaks or apices 22 within the operable flow range of the nozzle 10 of the invention. As above mentioned, the fluid flow through the nozzle at a fixed field strength is totally dependent upon the fluid pressure within the cavity 42. Thus, the selection of a cavity pressure that provides too much flow to the nozzle tip 18 may cause a misfiring of a flow path 30 between the peaks 22 or flooding as the case may be. However, otherwise, the peaks 22 will form flow paths 30 in the operation of the nozzle. In specific embodiments, peaks 22 function in this manner to control the selected positioning of flow paths 30 so long as they are positioned from about 0.062 inches to two inches apart and are not spaced apart more than about two inches, peak to peak.

Target 84 has ground line 74 enabling target 84 to attract charged droplets 100 to its surface. Inducting bar 72 is electrically connected through resistor/capacitor-/inductor network 94 to ground line 74. Inducting bar 72 is of a sufficient size so that when positioned an appropriate distance from emitting end 44 it becomes inductively charged. Inducting bar 72 assists in both dropletizing flow paths 30 and directing charged droplets 100 upwardly toward target 84 as taught in U.S. Pat. No. 4,749,125, issued on Jun. 7, 1988. Inducting bar 72 should be used whenever nozzle body 10 is not close to target.

FIGS. 11, 12 and 13 show an asymmetrical nozzle configuration with a protruding tip 18 with serrations 20 forming a plurality of spaced apices 22 with apex space 24 extending along the entire length of emitting end 44 of nozzle body 10. Depending on the type of fluid used and the field intensity, various tip 18 configurations having different sized apex spaces 24 are available. Apices 22 of tip 18 concentrate the charge, thus, enhancing the field intensity at these points and reducing the likelihood of overflow or flooding of the nozzle. In all embodiments, tip 18 is from about 1/16 to about ½ inches from the distal end of upper member 32.

Figure 9:
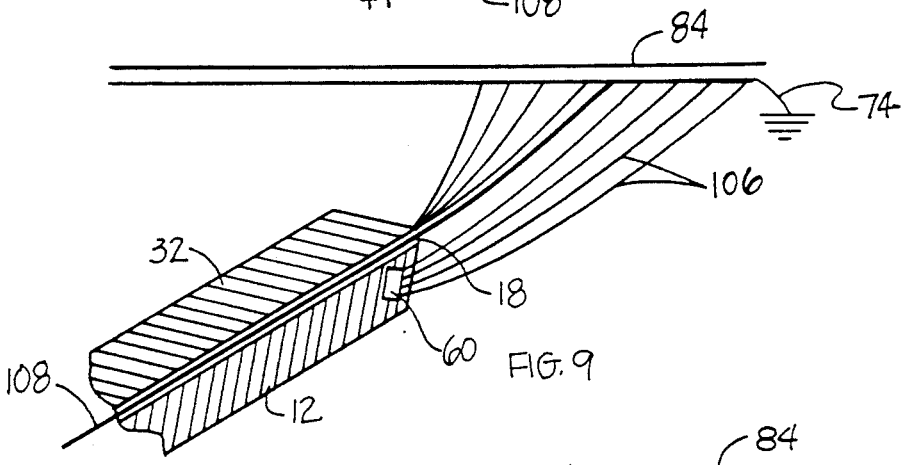
FIG. 9 is a cross-sectional view of a nozzle similar to FIG. 2 showing lines of force of the field surrounding the tip of a symmetrical electrostatic nozzle in accordance with the invention.

In the embodiments illustrated, electrode 60 is enclosed in ventral portion 16 of first and leading side member 12, as shown in FIG. 9. In another embodiment, electrode 60 is positioned within the proximity of nozzle tip 18 exterior of leading side member 12 so long as electrode 60 is properly insulated. A non-insulated electrode like electrode 60 may ionize the surrounding air and thus making it difficult to control flow paths 30. Electrode 60 and shim 58 are of like charge so that fluid residing at tip 18 is electrically repulsed countering the charged fluid's natural tendency to adhere to the surface of the nozzle material at emitting end 44, and fluid downwards over surface 19.

The increased control of the direction and intensity of the electric field between shim 58 and target 84 that is gained by serration 22 with spaces 24 is further enhanced by the large cut 14 and small cut 34 shown in FIGS. 11 and 12. Large cut 14 in ventral portion 16 of first leading side member 12 forms an inwardly extending ledge 19 and a lower edge 25 as shown in FIG. 12. This configuration extends the full length of emitting end 44 of nozzle body 10. This configuration coupled with the repelling force provided by electrode 60 significantly reduces the likelihood of fluid flooding of tip 18. In essence, by repelling the flowable material adjacent tip 18, the electrode 60 maintains the meniscus as it grows in size with the rate of flow of the flowable material through the nozzle on the lower jaw and maintains the Taylor cones in their proper "firing" position.

This configuration of the emitting end 44 also provides the nozzle with a method of self-cleaning as any flooding or overflow of fluid over nozzle tip 18 must go over lower edge 25 and the surface tension of the fluid breaks at lower edge 25 due to the repulsion of electrode 60 and further fluid stream formation over lower edge 25 is denied. New fluid is thrown upwardly by electrode 60 and the nozzle begins normal operation. The adhesive forces between the nozzle material and the fluid are overcome and an overall increase in the field intensity is created by electrode 60 and the charge concentrated at lower edge 25 and a subsequent increase in flow rate is possible.

In other words, the geometry of emitting end 44 having first leading side member 12 with cut 14 forming lower edge 25 and inward ledge 19 tends to break the surface tension between the fluid and nozzle material, and thus, tends to deny any continuous stream of fluid or flooding over nozzle tip 18. Electrode 60, as shown in FIG. 12, has a repelling force on the charged liquid within the Taylor cone forcing it upwardly, thereby diminishing any reduction in flow rates caused by the local adhesive forces between flowable materials and the nozzle material. The configuration of emitting end 44 of the invention shown in FIGS. 2, 6, and 1 through 13, also focus and punctuate, respectively, the direction and strength of the electric field between shim 58 and induction bar 72 or target 84, thus also increasing flow rates.

Relatively low electrical energies are also used with the nozzle of the invention. The actual electrical energy used is however dependent upon the target composition, the fluid properties and the spacing of the target from the nozzle tip 18. Usually voltages range from 10-50 kV at 300-60 micro amps of current, respectively. Usually, the energies consumed by the nozzle of the invention are, for example, from about 1 watt to about 3 watts per foot of nozzle.

In operation, a plurality of nozzles may be positioned adjacent each other thereby gaining even greater flow rates. Nozzle body 10 emits flowable materials upwardly in the form of flow paths 30 or charged droplets 100 as shown in FIG. 11 in a highly controllable manner.

A liquid meniscus 28 is formed at tip 18. An operational liquid meniscus 28 is formed by the low hydrostatic pressure imposed upon the liquid and the geometry of nozzle lips 26 and 38. The lower lip may be serrated or smooth depending upon the application. Eruptive forces on the fluid are created by the action of the field imposed on the fluid by the shim 58 and the inductor bar or the target 84 as the case may be. The liquid meniscus 28 erupts into a plurality of flow paths 30 whose diameters are but a small fraction of the slot width of the nozzle. Depending upon the field strength, the hydrostatic head imposed, the shim geometry, the nozzle slot dimensions and geometry, and the viscosity characteristics of the fluid, flow paths can be made to erupt at wide intervals or as close as several diameters away from each other.

Either an inwardly (concave) or an outwardly (convex) disposed meniscus can be created by the relative position of the lips 26 and 38 and the selection of the fluid, as above discussed. An inwardly disposed meniscus intensifies the electrostatic field from the fluid by virtue of its sharp exposed edge which concentrates the charge, and thus finds use when the narrowest flow path spacing is required.

Figure 7:
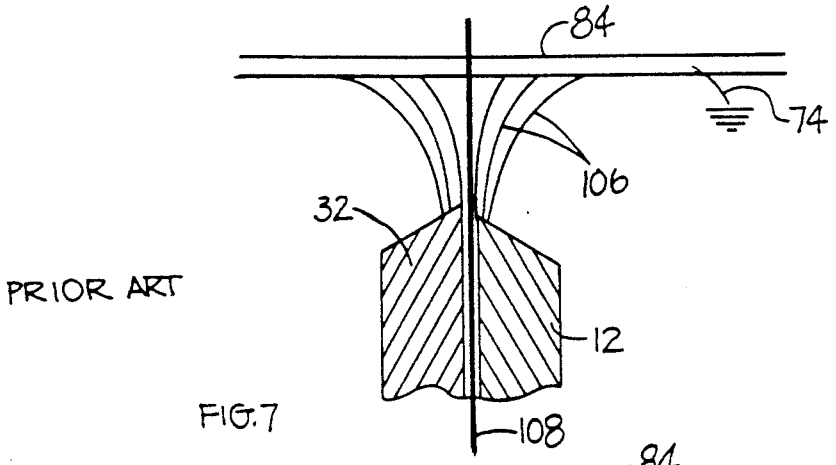
FIG. 7 is a cross-sectional view of a nozzle similar to FIG. 2 showing lines of force of the field surrounding the tip of a symmetrical electrostatic nozzle in accordance with the prior art.

Referring now to FIGS. 7 through 10, the improvement in the shoot-up electrostatic nozzles of the invention result from the increased control of the direction and intensity of the electric field between the nozzle 11 and the inductor bar 72, the forces provided by electrode 60 reducing the likelihood of fluid flooding of tip 18 and providing the self-cleaning aspects of the improved nozzle of the invention all result from the intensity and direction of the electrostatic field emanating about nozzle tip 18. FIG. 7 illustrates a symmetrical prior art electrostatic nozzle in which side members 12 and 32 are identically shaped in cross-section and are positioned together to include a slot 54, a chamber 42 and a nozzle tip 18 from which both members 12 and 32 taper symmetrically as shown in cross-section in FIG. 7. Emanating from nozzle tip 18 are a plurality of force lines of the field of the nozzle shown in FIG. 7 when the nozzle is charged. These force lines 106 emanate from the tip 18 entirely symmetrically so as to extend from the tip 18 and to slowly curve away from a center line 108. Thus, in FIG. 7, both the nozzle and the force lines 106 are symmetrical about center line 108.

Figure 8:
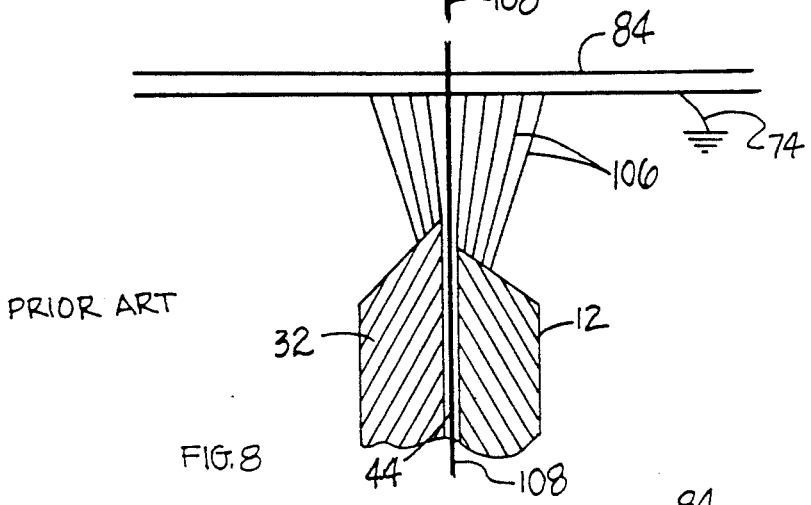
FIG. 8 is a cross-sectional view of a nozzle similar to FIG. 2 showing lines of force of the field surrounding the tip of an asymmetrical electrostatic nozzle in accordance with the prior art.

FIG. 8 shows an asymmetric nozzle much in the same manner as FIG. 7 shows a symmetrical nozzle. The asymmetrical nozzle of FIG. 8 has the same components of side members 12, 32, chamber 42 and slot 54. However, the force lines 106 while nearly symmetrical about center line 108 extend more upwardly than downwardly from center line 108 due to the asymmetrical geometry of the nozzle. For example, adjacent to the opening of slot 54, only upwardly extending force lines exist, whereas adjacent tip 18, force lines 106 are again symmetrical.

Figure 10:
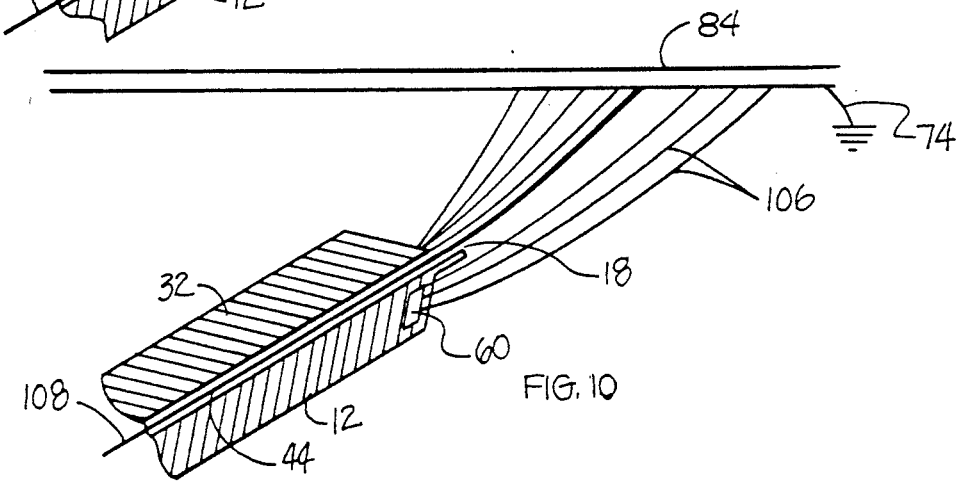
FIG. 10 is a cross-sectional view of a nozzle similar to FIG. 2 showing lines of force of the field surrounding the tip of an asymmetrical electrostatic nozzle in accordance with the invention.

FIGS. 9 and 10 show symmetrical and asymmetrical nozzles which include the enclosed electrode 60 of the invention adjacent to tip 18. Electrode 60 is charged with shim 58 by high voltage source 68, electrode 60 bends all of the force lines 106 upwardly in both of the nozzles shown in FIGS. 9 and 10 so as to result in force lines 106 which are in no way symmetrical about center line 108. In both the nozzles of the invention shown in FIGS. 8 and 9, the gravitational forces or flow forces of any fluid flooding over tip 18 must be overcome by the repelling force of electrode 60. Additional bending of the electrostatic field as diagrammically represented by force lines 106 is achieved by the use of the inductor bar 72 as shown in FIG. 13, as desired.

The nozzle body 10 is positioned with target 84 being in the general proximity above emitting end 44. When target 84 is a moving substrate above nozzle body 10, emitting end 44 can be either upstream or downstream from bottom 40. The liquid meniscus 28 errupts into a plurality of flow paths 30 along the length of emitting end 44 which travel upwardly along the electric field to target 84. Depending on the field strength of the target, the hydrostatic head imposed, the shim geometry, the nozzle slot dimensions and geometry, and the viscosity characteristics and resistivity of the fluid, flow paths can be made to errupt at wide intervals or as close as several diameters away from each other all along the length of emitting end 44 of nozzle body 10.

Either an inwardly or outwardly disposed meniscus 28 can be created by the relative position between the two side members 12, 32 and selection of the fluid, as discussed above. An inwardly disposed meniscus intensifies the electrostatic field by virtue of its sharp exposed edge which concentrates the charge, and thus finds use when the narrowest flow path spacing is required.

Thus, it can be appreciated that the present invention can emcompass any of a variety of geometries, the important characteristics being the selection of the shim and the placement thereof between the nozzle lips, the selection of the geometry of the shim and nozzle lips. Single and stacked nozzles as shown in FIGS. 2 and 3 are also contemplated.

The performance of the nozzle of the invention in terms of fluid path diameter is proportional to fluid flow rate and the number of the flow paths per inch as determined by the field strength between the nozzle and the target or inductor bar or free space. Flow path spacing is a function of the field strength between the nozzle and the target and the fluid flow to the nozzle lips, the nozzle lip shape and the physical properties of the fluid to be dispensed.

The improved upwardly emitting spray nozzle of the invention has increased flow rates while minimizing flooding and overflowing problems characteristic of an upwardly emitting electrostatic nozzles without operator assistance. The nozzle operates at safe and efficient voltages and is self-cleaning following purge cycles.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A nozzle for emitting flowable material upwardly comprising a nozzle body having an upper emitting end and a lower bottom end, said body having a hollow interior and a slot extending between said emitting end and said interior, a shim within said slot, at least one channel defined by said shim and said slot extending between said interior and said emitting end, and an electrode secured to said body adjacent to and below said emitting end to bend the Taylor cones of said material upwardly, a voltage source being electrically connected to said shim and said electrode, and a flowable material source in communication with said slot to provide said material in said slot at very small pressures, whereby flowable material flows through said channel to be electrostatically propelled upwardly from said emitting end once the Rayleigh charge of the flowable material is exceeded.

2. The nozzle of claim 1 wherein said emitting end is defined by upper and lower lips, said lips defining a distal tip extending outwardly from said emitting end, said tip being relatively thin adjacent to said emitting end.

3. The nozzle of claim 2 wherein said upper and lower lips are tapered toward said tip.

4. The nozzle of claim 2 wherein said nozzle tip is serrated, thereby defining a plurality of spaced apexes.

5. The nozzle of claim 4 wherein said apexes are equally spaced apart.

6. The nozzle of claim 4 wherein said apexes are spaced about 1/16 to about 2 inches apart.

7. The nozzle of claim 2 wherein said tip is an extension of said lower lip.

8. The nozzle of claim 2 wherein an inductive bar is positioned about 1-3 inches from said tip, said inductive bar being electrically grounded, whereby a charge is induced on said bar to direct the flowable material propelled from said emitting end upwardly.

9. The nozzle of claim 2 wherein said nozzle body is positioned obliquely to the horizontal with said bottom end being lower than said emitting end, said lower lip being ventral of said upper lip when said nozzle body is in said oblique position.

10. The nozzle of claim 9 wherein said electrode is within said lower lip of said body.

11. The nozzle of claim 2 wherein said electrode is adjacent to said tip.

12. The nozzle of claim 11 wherein said electrode is covered by insulation.

13. The nozzle of claim 2 wherein the flowable material in said body is under pressure, said pressure being less than about 15 psig, said flowable material flows through said cavity and channel and forms a meniscus at said emitting end.

14. The nozzle of claim 13 wherein said body on opposite sides of said slot is tapered thereby defining said nozzle lips, said lips being generally symmetrical about said slot adjacent to said tip.

15. The nozzle of claim 14 wherein said slot is filled with a flowable material, said flowable material in said channel adjacent to said tip forming a meniscus, said meniscus is convex, said meniscus erupts into a plurality of spaced flow paths of said material.

16. The nozzle of claim 15 wherein said high voltage source charges said flow paths greater than the Rayleigh charge, whereby said flow paths are formed into a plurality of charged minute droplets.

17. The nozzle of claim 15 further comprising a voltage biasing means positioned adjacent said tip, said biasing means subjecting said flow paths to an electrostatic field, said electrostatic field precipitating the formation of a plurality of charged droplets from said flow paths.

18. The nozzle of claim 15 wherein the spacing of said flow paths is a function of said charge and said flowable material pressure within said slot and the flowable material flow through said nozzle and the configuration of said nozzle and the properties of said flowable material.

19. The nozzle of claim 15 wherein said flowable material has a resistivity measured by a Ransburg Probe of greater than about $5.0\times10^6$ ohms.

20. The nozzle of claim 15 wherein said flowable material has a viscosity from 1 to about 20,000 centipoise.

21. The nozzle of claim 14 wherein at least one of said lips has a discontinuous distal edge.

22. The nozzle of claim 13 wherein said body on opposite sides of said slot is tapered thereby defining said nozzle lips, said nozzle lips about said slot adjacent to said tip being generally asymmetrical.

23. The nozzle of claim 22 wherein said slot is filled with flowable material, said flowable material within said channel adjacent to said tip forming a meniscus, said meniscus being concave, said meniscus erupts into a plurality of spaced flow paths of said material, said concave meniscus defining opposite meniscus edges at which an electrical charge may be concentrated.

24. The nozzle of claim 23 wherein said high voltage source charges said flow paths greater than the Rayleigh charge, whereby said flow paths are formed into a plurality of charged minute droplets.

25. The nozzle of claim 23 further comprising a voltage biasing means positioned adjacent said tip, said biasing means subjecting said flow paths to an electrostatic field, said electrostatic field precipitating the formation of a plurality of charged droplets from said flow paths.

26. The nozzle of claim 23 wherein said flowable material has a resistivity measured by a Ransburg Probe of greater than about $5.0\times10^6$ ohms.

27. The nozzle of claim 23 wherein said flowable material has a viscosity from under 1 to about 20,000 centipoise.

28. The nozzle of claim 22 wherein said lower lip extends outwardly of said nozzle beyond said upper lip, said upper lip has a smooth distal edge and said lower lip has a discontinuous distal edge.

29. The nozzle of claim 28 wherein said lower lip is serrated, thereby defining spaced apart apexes.

30. The nozzle of claim 29 wherein said apexes are spaced apart from about 1/16 to about 2 inches.

31. The nozzle of claim 28 wherein said discontinuous distal edge of said extended lip defines a single apex.

32. The nozzle of claim 1 wherein said nozzle body can be positioned greater than the horizontal and less than the vertical with said emitting end above said bottom end.

33. The nozzle of claim 1 wherein said shim is capable of conducting electricity.

34. The nozzle of claim 1 wherein said nozzle body is made of electrically insulative material.

35. The nozzle of claim 1 wherein said slot is linear.

36. The nozzle of claim 1 wherein said shim has a elistal edge of a discontinuous geometry with at least two peaks and at least one valley, said channel being at a valley of said discontinuous geometry.

37. The nozzle of claim 1 wherein said housing is of elastomeric material and said shim is of a metallic material.

38. The nozzle of claim 1 further comprising heating coils embedded in said body, said coils being operatively connected to an electrical power source, said heating coils imparting heat to said housing when said power source is activated.

39. The nozzle of claim 1 further comprising means for heating said body.

40. The nozzle of claim 1 further comprising at least one additional body and a shim for each additional body, said shim being positioned within said chamber slot of said additional body, said bodies being stacked, thereby providing a plurality of stacked nozzles.

41. The nozzle of claim 1 further comprising a target spaced from said nozzle, said target being chosen from the group of materials consisting of metals and metallic materials, wood, paper, glass, synthetic resins, plastics, plants, and food stuffs.

42. The nozzle of claim 1 further comprising a fluid delivery system, said fluid delivery system communicating with said slot such that flowable material within said system may flow into said slot from said system.

43. The nozzle of claim 42 wherein said fluid delivery system has flowable material pressure within said slot up to about 15 psig.

44. The nozzle of claim 1 wherein said voltage source applies a voltage to said shim and electrode from about 10 to about 50 kilovolts at about 60 to about 300 microamps of current, respectively.

45. The nozzle of claim 1 wherein the power consumption of said nozzle is up to 3 watts per foot of nozzle.

46. A method of electrostatically emitting flowable materials upwardly from a nozzle comprising the steps of delivering an electrically charged flowable material to the tip of an electrostatic nozzle at very small fluid pressures while passing said material over an electrical conductor mounted within said nozzle, concentrating the electrical charge on said nozzle at said tip thereof, forming an electrical field emanating from said tip by electrically connecting a voltage source to said conductor and an electrode secured to said nozzle adjacent to and below said tip, isolating said tip from the remainder of said nozzle by providing downwardly facing nozzle body surfaces which precipitously fall away from said tip, electrostatically repelling toward said tip any flowable material on said nozzle body surfaces, and bending said electric field adjacent said tip upwardly toward said target by charging said conductor and said electrode with a charge of the same polarity, whereby the Taylor cones of said flowable material are bent upwardly at said tip and said flowable material is electrostatically propelled upwardly from said nozzle once the Rayleigh charge of said flowable material is exceeded.

47. The method of claim 46 wherein said tip is elongated.

48. The method of claim 46 wherein said tip is serrated whereby said charge is concentrated at each serration of said tip.

49. The method of claim 46 wherein said tip extends from said body, said body diverges away from said tip.

50. The method of claim 49 wherein said tip extends from said body from about 0.019 to about 0.25 inches.

51. The method of claim 46 wherein said bending step includes placing a conductor spaced from and adjacent to said tip, electrostatically biasing said conductor through a circuit network, causing said flowable material to pass adjacent to said conductor.

52. The method of claim 46 wherein the rate of flowable material dispensed from the nozzle is a linear function of the fluid pressure within said nozzle at a selected field strength over the controlled operable range of said nozzle.

53. The method of claim 46 wherein the location of the flowable material emananting from the nozzle is at the concentration of said charge at the tip of said nozzle.

54. The method of claim 46 further comprising a target spaced from said nozzle, said target being chosen from the group of materials consisting of, articles of metals and metallic materials, wood, paper, glass, synthetic resins, plastics, plants, and food stuffs.

55. The method of claim 46 wherein said flowable material has a resistivity measured by a Ransburg Probe of greater than about $1.0\times10^5$ ohms.

56. The method of claim 46 wherein said flowable material has a viscosity of from about 1 to about 20,000 centipoise.

57. The method of claim 46 wherein said flowable material is charged by applying a voltage to said material from about 10 to about 50 kilovolts at about 60 to about 300 microamps of current, respectively.

58. The method of claim 46 wherein the power consumption of said nozzle is about 3 watts per foot of nozzle tip.

* * * * *